United States Patent [19]

Wood

[11] 4,206,158

[45] Jun. 3, 1980

[54] SONIC FLOW CARBURETOR WITH FUEL DISTRIBUTING MEANS

[75] Inventor: Jack L. Wood, Dearborn, Mich.

[73] Assignee: Ford Motor Company, Dearborn, Mich.

[21] Appl. No.: 674,007

[22] Filed: Apr. 5, 1976

[51] Int. Cl.[2] ..... F02M 27/08

[52] U.S. Cl. ..... 261/62; 261/DIG. 56; 261/DIG. 58; 261/DIG. 78

[58] Field of Search ..... 261/DIG. 78, DIG. 56, 261/DIG. 58, 62

[56] References Cited

U.S. PATENT DOCUMENTS

| | | | |
|---|---|---|---|
| 1,134,365 | 4/1915 | Barnes | 261/44 R |
| 1,526,317 | 2/1925 | Chandler | 261/DIG. 58 |
| 1,736,239 | 11/1929 | Wilson | 261/DIG. 78 |
| 1,973,362 | 9/1934 | Weiertz et al. | 261/44 R |
| 1,990,702 | 2/1935 | Leibing | 261/69 A |
| 2,118,220 | 5/1938 | Mock | 261/DIG. 56 |
| 2,332,916 | 10/1943 | Johnson | 261/DIG. 78 |
| 2,726,073 | 12/1955 | Seld | 261/72 R |
| 3,069,146 | 12/1962 | MacNeill | 261/62 |
| 3,143,401 | 8/1964 | Lambrecht | 261/DIG. 78 |
| 3,659,572 | 5/1972 | Pelizzoni | 261/DIG. 56 |
| 3,778,038 | 12/1973 | Eversole et al. | 261/DIG. 78 |
| 3,949,025 | 4/1976 | Englert et al. | 261/DIG. 58 |

FOREIGN PATENT DOCUMENTS

| | | | |
|---|---|---|---|
| 77094 | 4/1947 | Czechoslovakia | 261/DIG. 56 |
| 2053991 | 5/1972 | Fed. Rep. of Germany | 261/DIG. 78 |
| 506233 | 5/1939 | United Kingdom | 261/62 |

OTHER PUBLICATIONS

Hermann, Supersonic Inlet Diffusers, 1956, Minn.-Honeywell Co., pp. 1-9.

*Primary Examiner*—Tim R. Miles
*Attorney, Agent, or Firm*—Robert E. McCollum; Clifford L. Sadler

[57] ABSTRACT

A method and apparatus for uniformly distributing fuel into the cylinders of an internal combustion engine by introducing fuel into a variable area, sonic flow, convergent-divergent nozzle type carburetor at a location below the throat in close proximity to the shock wave and always within a narrow width axially extending zone that during sonic flow engine conditions in the passage provides good fuel spray characteristics without flow separation from the walls of the passage regardless of the changes in manifold vacuum level or flow area of the nozzle.

5 Claims, 13 Drawing Figures

EFFECTIVE ZONE OF GOOD SPRAY DISCHARGE

SONIC FLOW CARBURETOR WITH FUEL DISTRIBUTING MEANS

Figure 1:
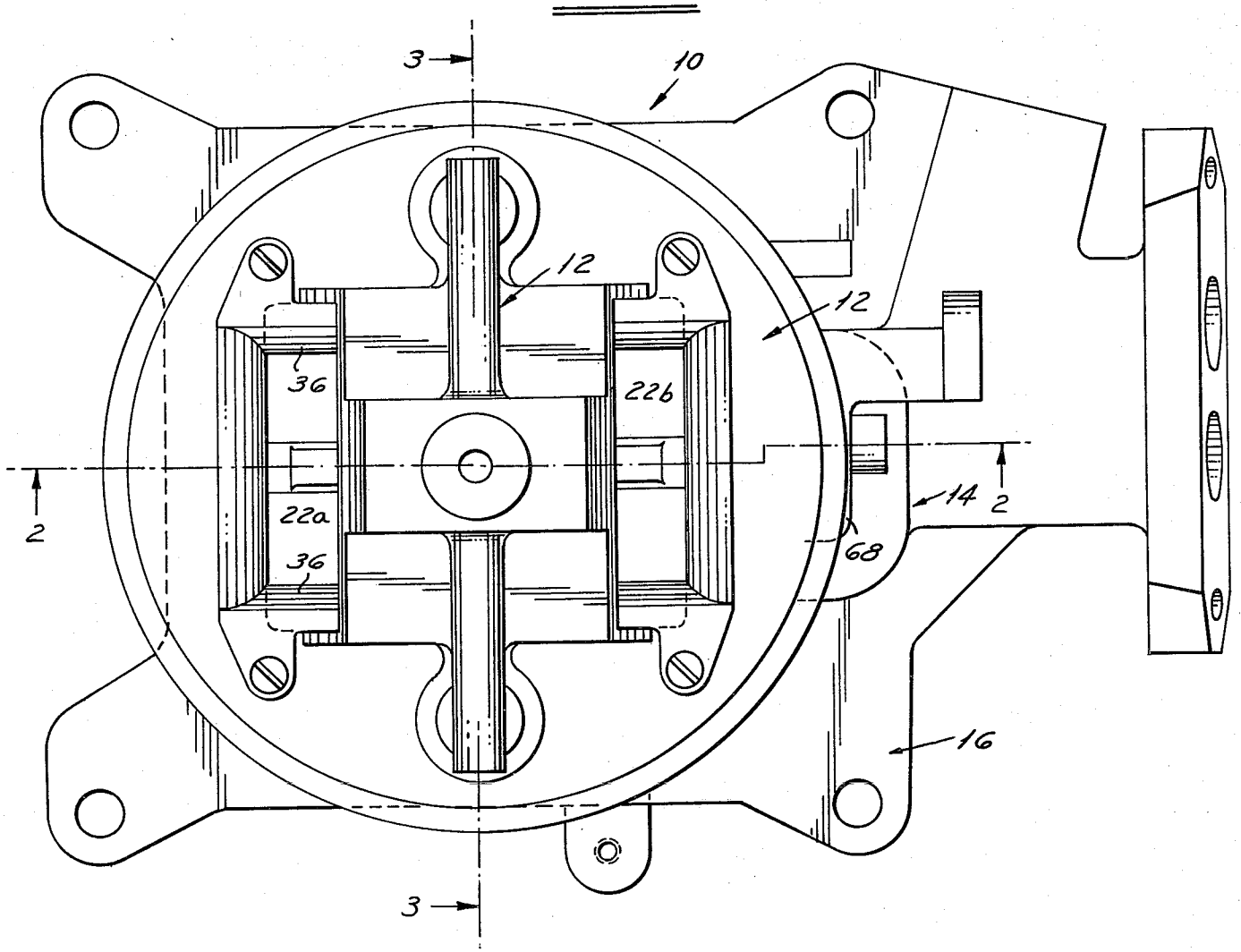

This invention relates to a sonic flow, variable area venturi type carburetor. More particularly, it relates to a method and apparatus for uniformly distributing fuel into the air stream flowing through such a carburetor to provide better engine cylinder-to-cylinder fuel distribution than is presently accomplished.

Sonic flow carburetors are known in which fuel is mixed with the air stream in a carburetor and accelerated to sonic velocity and beyond to atomize and distribute the fuel into the air stream. An example of such is shown and fully described in U.S. Pat. No. 3,778,038 issued Dec. 11, 1973 to James S. Eversole et al and entitled "Method and Apparatus for Mixing and Modulating Liquid Fuel and Intake Air for an Internal Combustion Engine." The patent describes and shows a carburetor-like body containing a variable area venturi constructed so that when fuel is introduced into the subsonic velocity incoming air stream, the mixture flow is raised to sonic velocity in the throat of the convergent-divergent nozzle defined by the venturi, the flow velocity is further increased to supersonic downstream of the throat, and then abruptly decreased to subsonic across a shock wave generated in the diverging nozzle portion.

While the stated purpose of the above patented device is to uniformly distribute the fuel into the air stream, experiments conducted using such a construction have shown that the flow at times actually separated or was diverted from one or both of the shaped walls of the diffuser, which resulted in stagnate or recirculating air pockets in the void created by the separation. These pockets of recirculated air carried some fuel with them which re-entered the main stream at different times and locations. This resulted in a general condition of stratified flow that was sporadic in nature, with the main stream occasionally reattaching itself to one or both walls, or switching from side to side in the diffuser. It is theorized that the presence of the shock wave in the diffuser may have created an abrupt pressure rise in the flow direction which stalled the boundary layer and caused flow separation. The latter phenomena is well understood and documented.

This invention seeks to eliminate the above disadvantages in such a carburetor by introducing the fuel into the air stream after it has passed through the throat of the convergent-divergent nozzle, and in close proximity to the shock wave location within a relatively narrow band or zone, within which the shock wave floats, which during sonic flow operating conditions in the passage provides good spray characteristics without flow separation regardless of changes in manifold vacuum levels or changes in the ratio of the area of the throat with respect to the nozzle exit area. Introduction of the fuel in this manner will maintain uniform distribution of the fuel into the air stream flowing into the engine cylinders over essentially the entire engine idle and part throttle operating conditions. The fuel, in some instances, is introduced into the air stream above the shock wave where the flow is supersonic, at other instances below the shock wave where the flow is subsonic, and still at other times essentially at the shock wave location.

The introduction of fuel into a supersonic velocity air stream in a carburetor for fuel atomization and uniform distribution into the engine cylinders is known, as described and shown by German publication No. 2,053,991, published May 10, 1972, entitled "Device for Feeding, Admixing and Improving the Atomization of a First Medium within a Second Medium Under the Effect of Vacuum and/or Pressure." The stated purpose of the latter patent is to atomize and uniformly distribute the fuel into the air stream, particularly during cold start and idle speed conditions as well as in conjunction with changing engine speeds and/or loads so that the mixture is free of condensate and drops. The German publication shows a preferred embodiment operable in the idling range exclusively. It shows a fixed area venturi or outer nozzle in which is positioned an inner nozzle. Within the inner nozzle is located a fuel pintle or needle which is shaped to provide with the outer nozzle a convergent-divergent fuel passage. This provides a throat section between the inner nozzle and fixed area venturi and throat section for the venturi downstream of the inner nozzle. The publication describes the improvement of the mixture conditioning as being on the basis that a gas flowing at a supersonic velocity contains a greater energy and can thus as well give off more energy than a gas expanding at less than supersonic speed. A shock wave is created in the diverging section which results in a superatomization and homogeneous distribution of the air/fuel mixture.

While the German publication describes the introduction of fuel into the supersonic section of a carburetor air stream followed by a reduction to subsonic flow through a shock wave, it fails to teach any correlation between the point of introduction of the fuel and the location of the shock wave. It should further be noted that while the German reference states that the device should be adjustable, it makes no provision for varying or changing the outer nozzle throat area so as to vary flow volume while retaining sonic flow during changing operating conditions of the engine. The German reference appears to be directed towards an idling system in which a fixed area flow would be conventional.

In a carburetor embodying the invention, a variable area venturi is provided to vary the flow area and provide the varying air flow requirements of the engine with a single fuel system rather than an idling system separate from a main fuel system, as is conventional.

It is a primary object of this invention, therefore, to provide a method and apparatus for uniformly distributing fuel into the air stream of a sonic flow type carburetor for uniform distribution and flow of the fuel into the engine cylinders by introducing the fuel into a portion of a sonic nozzle at a predetermined location with respect to the shock wave generated in the nozzle so as to prevent flow separation.

It is another object of the invention to provide a carburetor of a type described above that includes a converging-diverging venturi or nozzle in the carburetor induction passage in which an air stream is accelerated to sonic velocity at the throat section between the converging and diverging portions, is accelerated to supersonic velocity downstream of the throat, and abruptly decelerated to subsonic velocity by passage through a shock wave that floats axially between positions varying as a function of changes in engine manifold vacuum levels acting on the exit portion of the nozzle and the ratio change between the area of the throat and the nozzle exit area, the fuel being introduced into the nozzle in close proximity to the shock wave within a narrow width axially extending band within which the shock wave floats during engine part throttle operating conditions, thereby effecting the introduction of fuel into the passage with good fuel spray characteristics without flow separation from the walls of the passage, at times into a subsonic velocity zone below the shock wave, at other times into a supersonic velocity zone above the shock wave, and at still other times essentially at the shock wave location itself.

It is a still further object of the invention to provide a carburetor of the type described immediately above with a fuel introduction means of fixed configuration.

Figure 2:
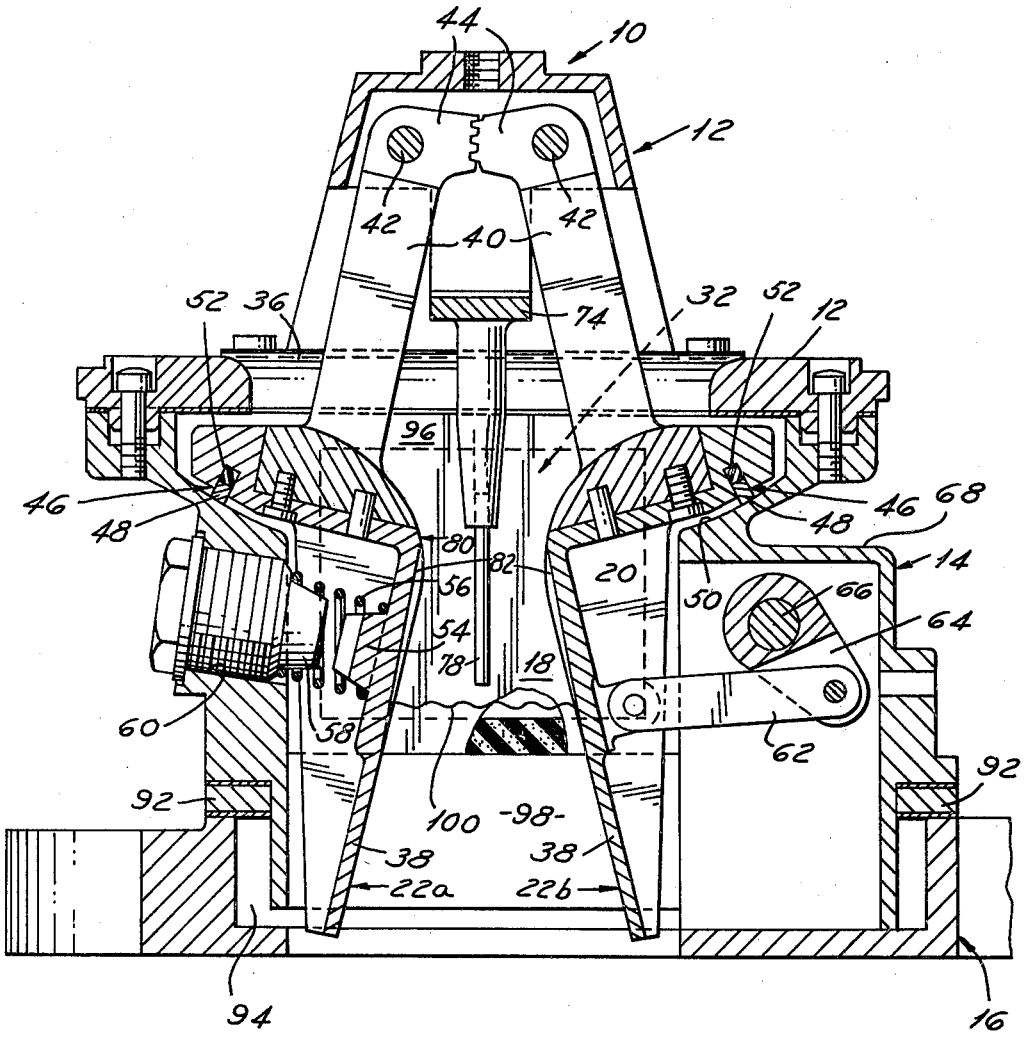
Figure 3:
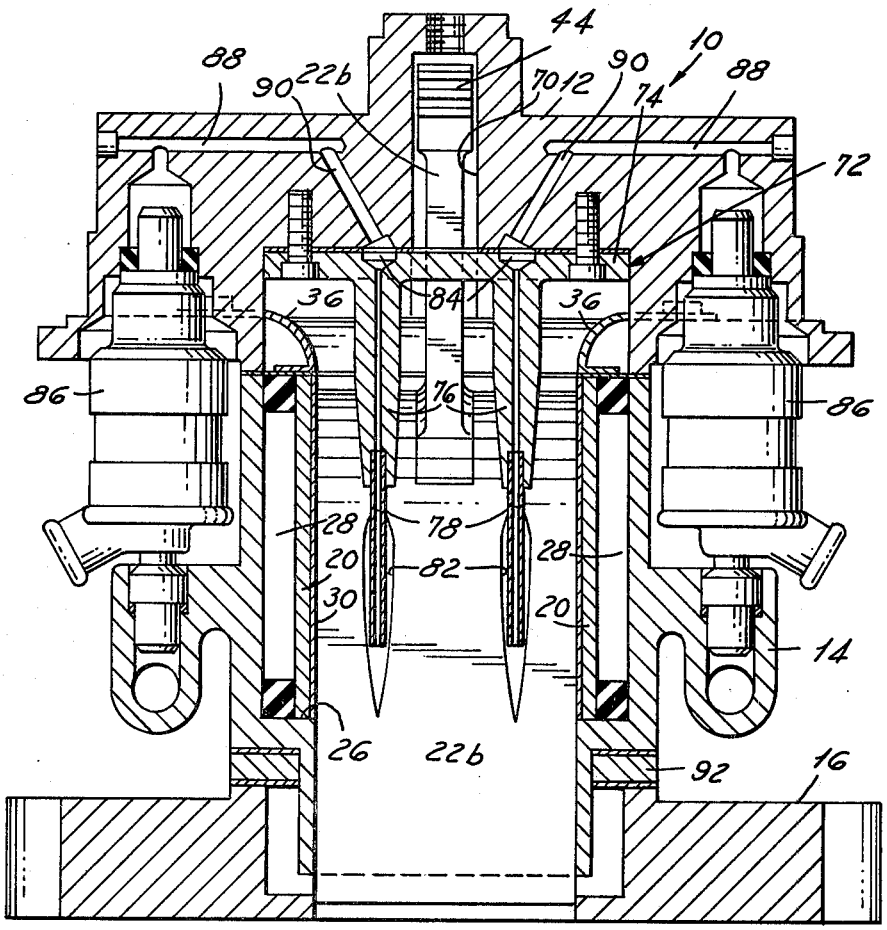
Figure 3A:
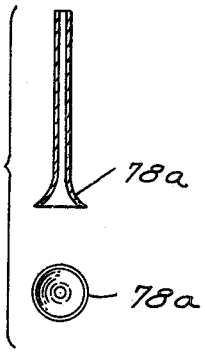
Figure 3B:
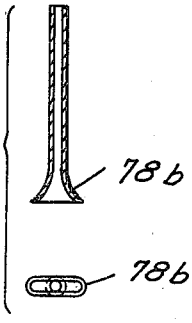
Figure 4A:
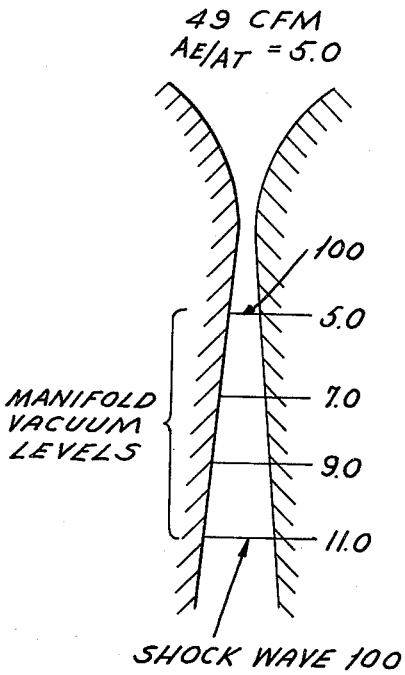
Figure 4B:
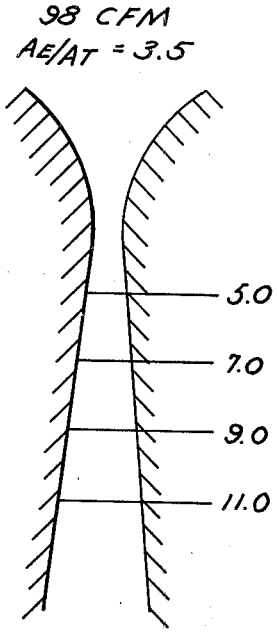
Figure 4C:
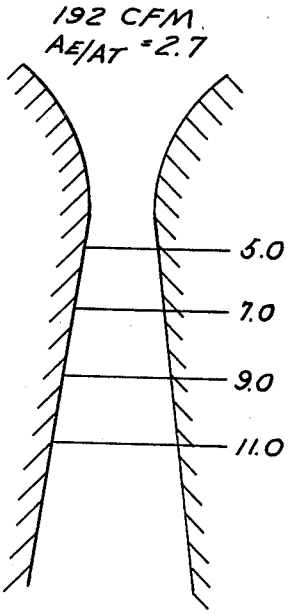
Figure 5:
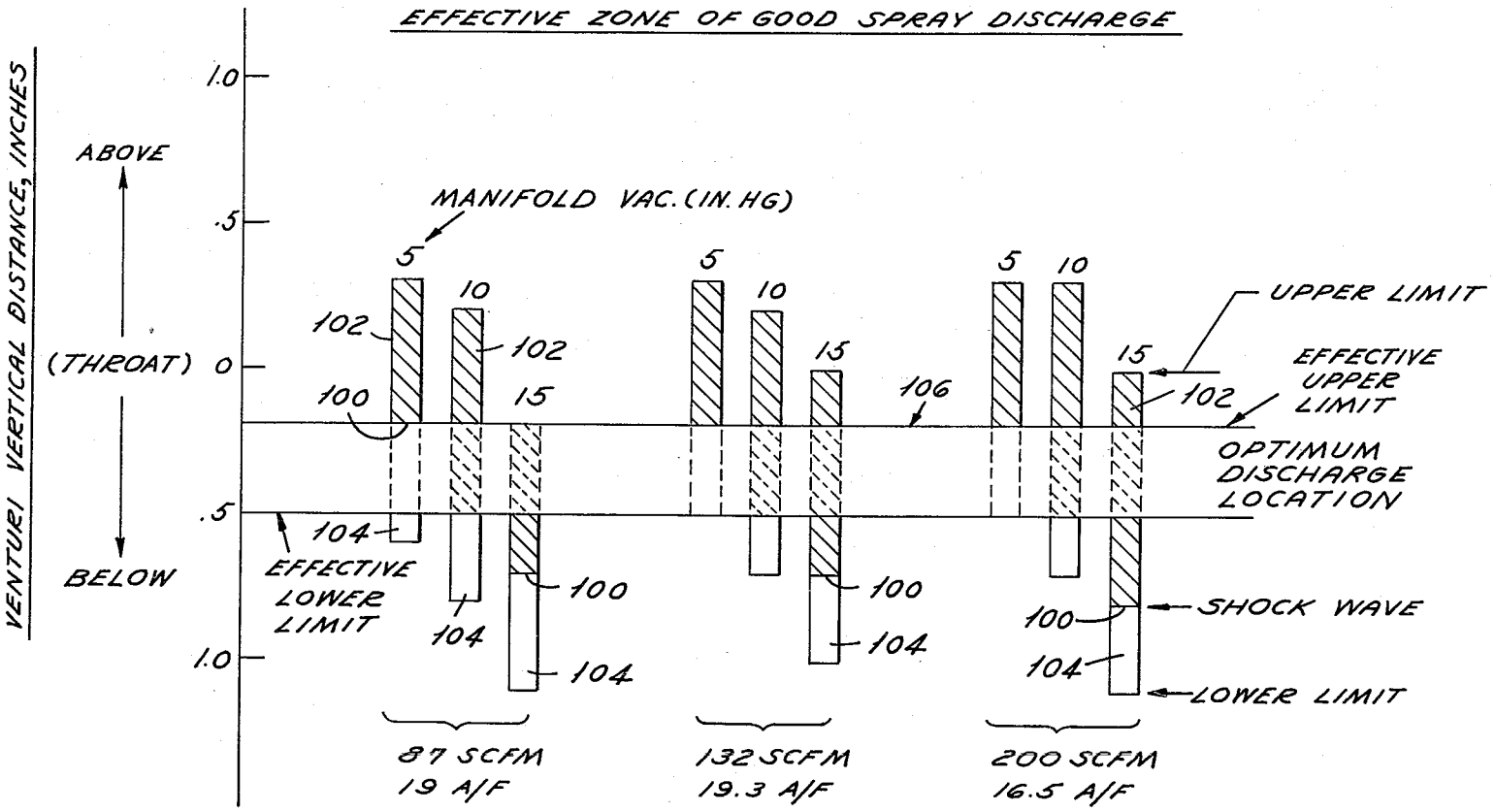

Other objects, features and advantages of the invention will become more apparent upon reference to the succeeding detailed description thereof, and to the drawings illustrating a preferred embodiment thereof; wherein, FIG. 1 is a top plan view of a portion of a carburetor embodying the invention;

FIGS. 2 and 3 are cross-sectional views taken on planes indicated by and viewed in the direction of the arrow 2—2 and 3—3, respectively, of FIG. 1;

FIGS. 3*a* and 3*b* are modifications of a detail in FIG. 3;

FIGS. 4*a*, 4*b* and 4*c* schematically illustrate the changing location of the shock wave in response to variations in manifold vacuum levels, for various nozzle flow areas;

FIG. 5 graphically illustrates the relationship between location of fuel introduction in the nozzle and good fuel distribution as a function of changing manifold vacuum levels and changes in the ratio between the area of the throat and the nozzle exit area; and, FIGS. 6*a*, 6*b*, 6*c* and 6*d* schematically illustrate the carburetor flow passage fuel distribution pattern changes in response to changes in the location of the introduction of the fuel into the air stream.

As stated above, it is a primary purpose of the invention to uniformly distribute the fuel into the air stream of a carburetor so as to eliminate the normally large air/fuel ratio spread between engine cylinders. This is accomplished by introducing the fuel below the throat of the convergent-divergent nozzle in close proximity to the shock wave generated in the diffuser, and within a narrow width band or zone through which the shock wave floats during engine idle and part throttle manifold vacuum changes. It is theorized that the introduction of fuel into the supersonic velocity section for example, presents a bluff body to the air stream creating a bow or oblique shock upstream of the normal shock wave. This bow or oblique shock thus causes the air stream to be diverted or fanned out uniformly in a conical-like shape to thereby not only uniformly mix and distribute the fuel into the air stream, but also completely fill the passage.

Figure 6A:
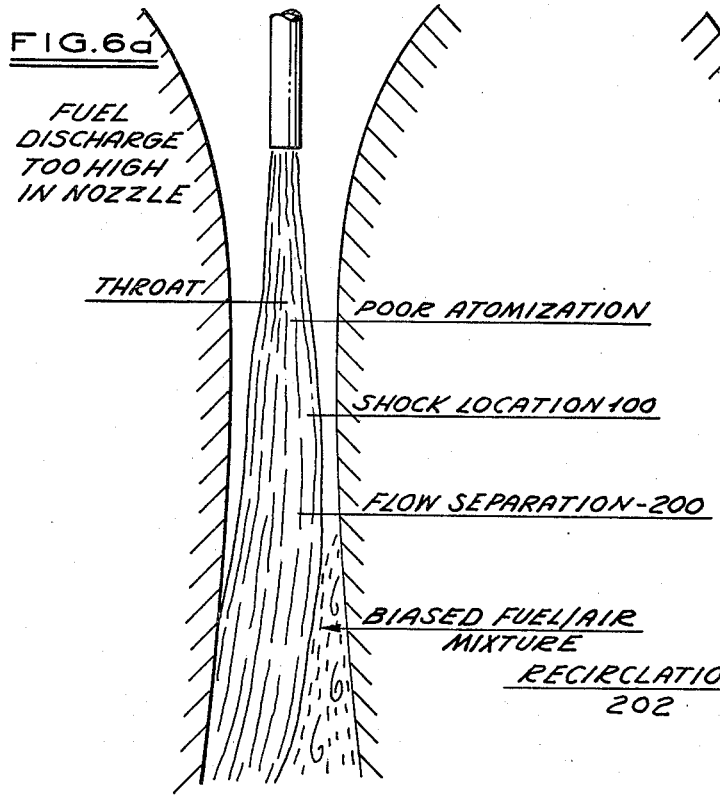
Figure 6B:
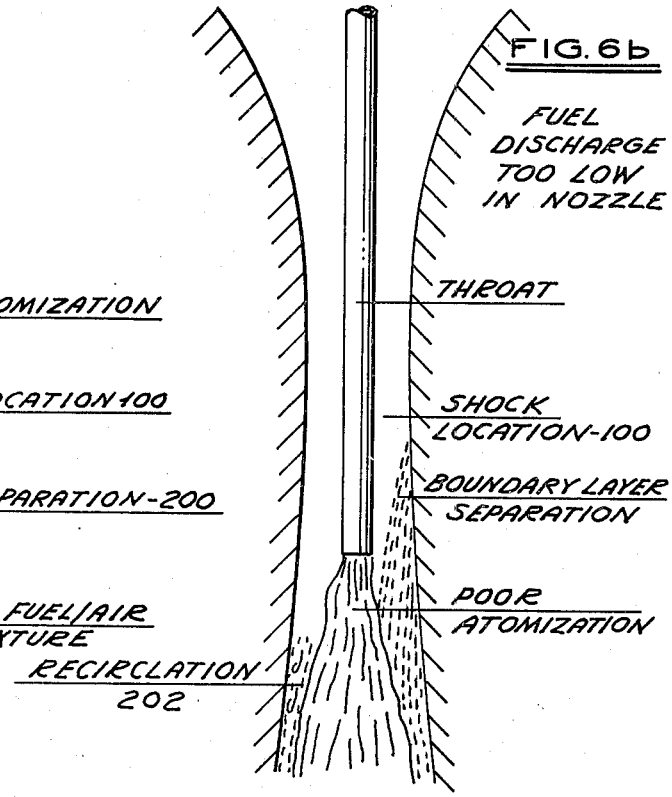
Figure 6C:
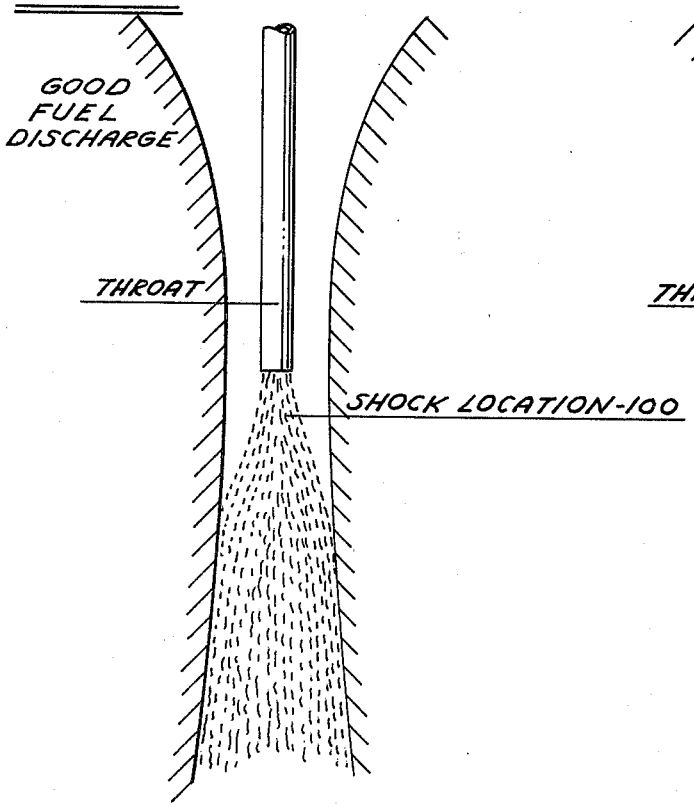
Figure 6D:
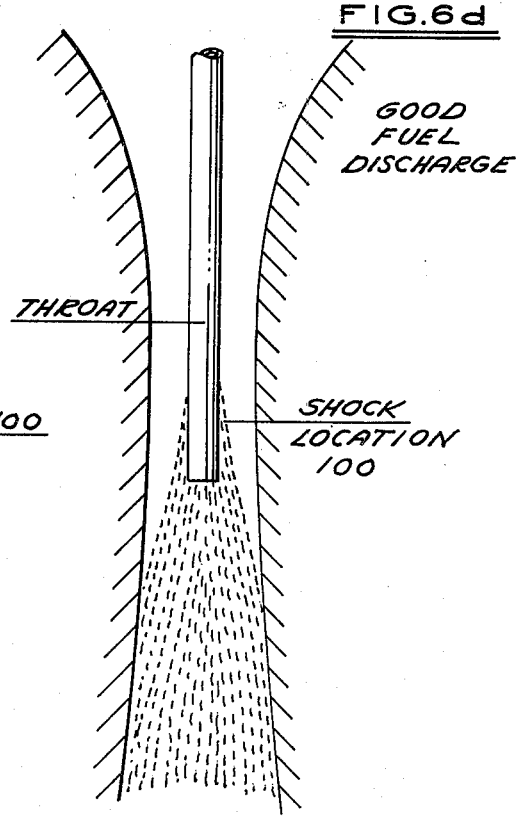

It is believed the interaction of the fuel particles with the normal shock by the fuel creating an obstacle modifies the normal shock wave to create an oblique shock wave causing a change in direction of the air stream and thereby providing the desired mixing effect. Similarly, introduction of the fuel into a subsonic flow air stream below the shock wave again provides an interaction of the fuel with the air at the shock wave because of the large pressure differential across the shock wave causing a sucking back across the shock wave of the fuel, as is indicated in FIG. 6*d*, and will become clearer later.

In contrast, when the fuel is introduced outside the effective zone of good fuel spray discharge, to be described, it has been observed that flow separation or switching of the mixture stream from one side to the other occurs in the diffuser portion of the nozzle. It may be that in introducing the fuel above the throat, for example, the fuel particles are already accelerated to the speed of the air stream by the time the air fuel mixture stream goes beyond the throat, i.e., being at the same speed as the air stream, the fuel particles then follow known principles for flow of air, resulting in boundary layer stall and flow separation. This, of course, causes poor fuel distribution downstream of the nozzle.

Referring now to the drawings, FIGS. 1-3 show a single barrel, sonic flow carburetor 10 of the downdraft type. It includes an upper air horn section 12, a main fuel metering body 14, and a base 16. The base is adapted to be mounted over and bolted to the intake manifold of an internal combustion engine for passage of the air/fuel mixture from the carburetor into the engine cylinders.

The carburetor has an induction passage 18 that is rectangular in cross-section and variable in area. The passage contains a variable area venturi defined by oppositely facing stationary walls 20 and a pair of facing, mirror image, swingably mounted air valve members 22*a* and 22*b*. As best seen in FIGS. 2 and 3, the stationary side walls 20 each include a combination t-shaped plate and seal that is mounted on a shoulder 26 in the main fuel metering body 14 against a similarly shaped sponge rubber backing pad 28. Each plate on its inner face 30 is coated with a combination seal and anti-friction material. The sponge rubber pad 28 has a central opening 32 that is in communication with the induction passage 18 through a sized hole, not shown, for pressure balancing purposes. In assembly, the sponge rubber pads 28 are slightly compressed when the movable air valve members 22*a* and 22*b* are installed, to provide an essentially leak-proof wiping action with the air valves. A pair of air deflecting members 36 are secured to the air horn section over the entrance to induction passage 18 to provide a smooth entrance air portion.

FIG. 2 shows the arcuately formed air valves 22*a* and 22*b* as essentially L-shaped plates 38 each having the profile of one-half of a converging-diverging (C-D) nozzle, and fixed to the bottom of a valve control arm 40. The arms are individually pivotally mounted on the air horn section 12 on shafts 42, with interengaging gear segments 44 effecting a simultaneous or concurrent arcuate swinging or pivotal movement of the arms in opposite directions to contract or enlarge the throat and nozzle exit areas. Each air valve contains a sliding seal member 46 that includes a seal 48 resiliently urged against the arcuate surface 50 of the main fuel metering body 14 by a sponge rubber pad 52.

As seen in FIG. 2, the left hand air valve 22*a* has a boss 54 over which is mounted a spring 56 that normally urges the air valve to a closed or contracted venturi area position. The opposite end of the spring is mounted against a plug 58 that is secured in and projects through an opening 60 in the main fuel metering body 14. The opposite air valve 22*b* is pivotally connected by a link 62 to a lever 64 fixed on a shaft 66. The latter is mounted in the side walls of a housing 68 formed in the main fuel metering body 14. The shaft 66 is connected by means not shown to the conventional vehicle accelerator pedal operated by the vehicle driver so that the air valves 22*a* and 22*b* will be opened against the force of spring 56 upon depression of the accelerator pedal to increase the flow area.

FIG. 3 shows the air horn section 12 having central recess 70 in which, as seen in FIG. 2, is centrally mounted a stationary fuel rail assembly 72. The latter consists of a base plate 74 from which depend two fuel passage containing members 76. The latter each receives a constant area and diameter hollow fuel discharge tube 78 that, as seen in FIG. 2, projects to a fixed location below the throat or most constricted flow area 80 of the venturi. The faces of air valves 22*a* and 22*b* each have cutouts or scallops 82 aligned with the fuel discharge tube so as not to interfere with closing of the nozzle or venturi to its smallest flow area or closed position, as the case may be. The hollow tubes 78 are centrally located in one lateral direction with respect to the air valves 22*a* and 22*b*, as seen in FIG. 2, and in the other direction symetrically spaced from each other and the stationary walls 20, as seen in FIG. 3. FIGS. 3*a* and 3*b* show alternate constructions of the ends of the tubes 78, FIG. 3*a* showing a flared round end 78*a*, and FIG. 3*b* showing a flared oblong or flattened end 78*b*.

The fuel rail base plate 74 has a pair of fuel inlets 84 that receive fuel from a pair of fuel injectors 86 from connecting passages 88 and 90. The injectors in this case can be of any known design for presenting fuel to the fuel passages under slight pressure in a known manner. Alternately, a fuel float bowl type fuel supply system could be used. The details of construction and operation of the fuel metering system per se are not given since they do not form a portion of the present invention. All that is necessary is to present fuel to the discharge tubes 78 for induction into the venturi and induction passage as a result of the pressure differential across the end of the tubes 78 by the engine manifold vacuum acting thereon during all engine operations.

Completing the construction, the lower end of the main fuel metering body 14 is attached to the base 16 with an annular gasket 92 between. The latter cooperates with a passage 94 (FIG. 2) opening into the induction passage adjacent the discharge or exit end of the nozzle for the introduction of exhaust or crankcase gases in a known manner.

As thus far described, it will be seen that the variable area venturi includes a converging air flow portion 96, a diverging flow portion 98 defined by the diverging walls of the air valves 22*a* and 22*b*, and the throat 80 connecting the two portions. The geometric design and configuration is so defined as to provide a converging-diverging critical mode flow nozzle in which the ambient pressure air inducted into the converging portion 96 is increased to sonic velocity at throat 80, further increased to supersonic velocity slightly downstream of throat 80, and changed abruptly to subsonic velocity across a shock wave in the diffuser, all in a known manner, as described and shown, for example, in U.S. Pat. No. 3,778,038 referred to above. In brief, the construction of the nozzle is such that for all sonic flow operating conditions, i.e., essentially all idle and part throttle operating conditions of the engine, the ratio of the pressure at throat 80 to ambient pressure at the air inlet is maintained at 0.528 to provide the sonic and supersonic flow described, and the divergence of the walls of the diffuser is such as to provide a pressure gradient between the exit of the nozzle or diffuser and the throat 80 to generate a shock wave, illustrated schematically at 100 in FIG. 2, across the diffuser portion 98.

The actual axial location of the shock wave will, of course, vary in a known manner as a function of the changes in back pressure at the exit of the nozzle or diffuser portion 98. That is, as the back pressure at the exit of the nozzle decreases above a critical value, the shock wave will move axially downwardly toward the exit of the nozzle or diffuser. Conversely, as the vacuum decreases (and absolute pressure increases), the shock wave will gradually move upwardly towards the throat and eventually be "swallowed" by the throat when the flow changes from sonic to subsonic when the throat to ambient pressure can no longer support sonic flow.

Similarly, the shock wave will move vertically with changes in area ratio between the throat and exit upon movement of the air valves changing the area of the throat of the venturi upon movement of the air valve portions 22*a* and 22*b* by link 62. This is caused, of course, by the enlargement of the venturi or C-D nozzle area changing the pressure differential and, therefore, changing the point at which the flow abruptly decreases from supersonic to subsonic. That is, the vertical location of the shock wave will vary inversely as a function of the change in area of the venturi or C-D nozzle flow area.

Therefore, it will be seen that the shock wave floats as a function in changes of venturi area and/or manifold vacuum levels, or a combination of the two. A change in area alone will change the location of the shock wave, and a change in manifold vacuum will likewise change the location of the shock wave.

FIGS. 4*a*–4*c* illustrate schematically the change in location of the shock wave 100 both with changes in manifold vacuum and flow area. For example, FIG. 4*a* illustrates the position of the air valves providing a flow of 49 cubic feet per minute and an area ratio of the exit of the nozzle over the throat equal to 5. The stronger the vacuum force, the lower the position of shock wave 100. FIGS. 4*b* and 4*c* show the area of the nozzle adjusted for flows of 98 cfm and 192 cfm, respectively, with area ratios of 3.5 and 2.7, respectively. It will be seen from FIGS. 4*b* and 4*c* that the shock wave 100 moves vertically with the changes in manifold vacuum level.

As stated previously, it is a primary object of this invention to provide a method and apparatus of distributing fuel into the air stream flowing through the variable area venturi so that essentially uniform cylinder to cylinder distribution occurs in the engine. As also stated previously, this is accomplished by discharging the fuel into an essentially narrow axially extending band or zone within which the shock wave floats during part throttle operating conditions of the engine. This is accomplished by discharging the fuel into the passage at a location equally spaced from the moving walls and in close proximity to the shock wave during sonic flow operating conditions regardless of the vertical displacement of the shock wave in response to changes in manifold vacuum or venturi area changes.

FIG. 5 is a graphical illustration of the results of tests conducted by discharging fuel into a variable area venturi carburetor induction passage in the manner proposed, plotting location of fuel discharge with respect to the venturi throat against varying manifold vacuums and flow areas. The vertical bars represent the zone of discharge or the total range of locations on opposite sides of the shock wave within which the fuel can be discharged for good atomization and distribution of fuel in the diffuser for the various manifold vacuum levels and flows indicated without flow separation from the walls of the passage. That is, the horizontal line 100 between the cross-hatched portion 102 and the unlined portion 104 indicates the location of the shock wave relative to the throat of the venturi for that particular manifold vacuum level and area ratio. The cross-hatched portion 102 represents the vertical distances above the shock wave 100 in which the fuel can be discharged and still provide good spray distribution without flow separation. The unlined portion 104 represents the vertical locations below the shock wave in which the fuel can be discharged and still maintain good spray discharge without flow separation.

As will be seen, therefore, the bars represent the upper and lower limits at each particular manifold vacuum for each area ratio at which good spray distribution will occur without flow separation if the fuel is discharged within the zone defined by the bar. However, it will be noted that if the engine is to operate satisfactorily with good fuel atomization and distribution and no flow separation under all sonic flow operating conditions regardless of manifold vacuum changes, then the fuel must be discharged within the relatively narrow axially extending optimum band or zone 106 indicated on the chart. For example, the fuel must be discharged below the throat within the band or zone 106 indicated in order for the fuel distribution to be good at 5 inches Hg., at 87 SCFM flow, as well as at 132 SCFM, and 200 SCFM. While operating at 5 inches Hg. manifold vacuum, fuel distribution would be good at the throat or above as indicated, but when the manifold vacuum increases to 15 inches Hg., then fuel discharged at the same location would be outside the range for good spray discharge, and would be unacceptable. Similarly, when operating at 15 in. Hg., manifold vacuum, locating the fuel discharge at slightly below 1 inch below the throat would provide satisfactory distribution at 87 and 200 SCFM, but not at 132 SCFM, and not when the manifold vacuum changes to 5 or 10 inches Hg., at the different flow rates. Therefore, it will be seen that in order to satisfy all the requirements for good spray distribution without flow separation during sonic flow conditions, the fuel must be discharged within the zone 106 indicated as the optimum discharge location, and which contains the shock wave 100 as it floats during all lower or part throttle operating vacuums, the shock moving vertically as a function of changes in manifold vacuum and venturi flow area.

FIGS. *6a* through *6d* schematically illustrate the contrast between good fuel distribution with fuel discharge in the band or zone 106 indicated in FIG. 5, as contrasted with fuel discharge outside the zone. More specifically, FIG. *6a* shows erratic fuel distribution when the fuel is discharged into the air stream above the throat at manifold vacuum and air flow levels that are outside the range illustrated in FIG. 5. It will be noted that downstream of the shock location, separation of the boundary layer has occurred at 200 causing the flow to be diverted toward the left-hand side of the venturi. This will cause a concentration of the fuel mixture in some engine cylinders and inadequate fuel in others. FIG. *6b* also shows a similar occurrence when the fuel is discharged below the shock location and below the lower limits specified in the chart in FIG. 5. Again, in this case, separation of the flow occurs at 200 below the shock wave 100, and the flow is diverted towards the left-hand side of the venturi with unequal fuel distribution to the engine cylinders. The flow per se is erratic and not uniformly distributed in a conical pattern. Stagnant air pockets 202 are formed between the switching boundary layer and wall.

In contrast, the flow in FIGS. *6c* and *6d* shows good atomization and uniform distribution into the manifold. As seen in FIG. *6c*, the fuel is discharged slightly below the throat and above the shock wave location and results in a uniform conical pattern and a complete filling of the induction passage below the shock location. There is no separation of the boundary layer. As stated previously, it is theorized that the fuel flowing into a supersonic air stream in effect presents a bluff object that creates an oblique shock wave that diverts the air stream in the manner shown. Likewise, when the fuel discharge is placed below the shock location but still within the zone 106 through which the shock wave floats, as shown in FIG. *6d*, the large pressure differential across the shock wave causes the fuel to travel upwardly across the shock wave, as shown, to form a conical flow pattern of uniformly distributed fuel flowing into the manifold. It may be that the mere presence of the fuel discharge tube per se at the shock wave constitues a bluff object causing an oblique shock wave to the air stream to provide the uniform distribution.

From the foregoing, therefore, it will be seen that by following the teaching of the invention, by discharging the fuel into a narrow width axial zone through which the shock wave floats, whether it be into a supersonic air stream above the shock wave, at the shock wave, or below the shock wave in a subsonic flow area, uniform and good distribution of the fuel flow to all engine cylinders is achieved without flow separation, for all sonic flow conditions.

While the invention has been described and shown in its preferred embodiment, it will be clear to those skilled in the art to which it pertains that many changes and modifications may be made thereto without departing from the scope of the invention.

I claim:

1. A fuel distributing apparatus comprising a variable area venturi carburetor having an induction passage open to air at ambient pressure at one end and connected to the intake manifold of an internal combustion engine at the other end to be subject to the changing manifold vacuum or pressure depression therein, the passage having a variable flow area venturi defined by a converging-diverging nozzle having converging and diverging portions joined by a throat therebetween, the venturi having at least one wall movable in opposite directions to contract or expand the throat and nozzle flow areas, means moving the movable wall, the nozzle being so constructed and designed as to maintain sonic velocity to the flow through the throat over essentially the entire idle speed and part throttle operating range of the engine, with an increase to supersonic velocity downstream of the throat followed by a decrease to subsonic velocity by passage of the flow through a shock wave, the shock wave varying in location between the throat and exit portion of the nozzle as a function of the change in throat area and manifold vacuum levels, means to move the movable wall to change the throat and nozzle flow area, and means introducing fuel into the nozzle below the throat in close proximity to the shock wave and always within an axially extending band including the vertical positions of the shock wave attained in response to changes in nozzle flow area and/or manifold vacuum levels during part throttle operating conditions, the movable wall portion being pivoted adjacent its upper end for a swinging arcuate movement, the wall portion having the profile of one-half of a convergent-divergent nozzle.

2. A fuel distributing apparatus comprising a variable area venturi carburetor having an induction passage open to air at ambient pressure at one end and connected to the intake manifold of an internal combustion engine at the other end to be subject to the changing manifold vacuum or pressure depression therein, the passage having a variable flow area venturi defined by a converging-diverging nozzle having converging and diverging portions joined by a throat therebetween, the venturi having at least one wall movable in opposite directions to contract or expand the throat and nozzle flow areas, means moving the movable wall, the nozzle being so constructed and designed as to maintain sonic velocity to the flow through the throat over essentially the entire idle speed and part throttle operating range of the engine, with an increase to supersonic velocity downstream of the throat followed by a decrease to subsonic velocity by passage of the flow through a shock wave, the shock wave varying in location between the throat and exit portion of the nozzle as a function of the change in throat area and manifold vacuum levels, means to move the movable wall to change the throat and nozzle flow area, and means introducing fuel into the nozzle below the throat in close proximity to the shock wave and always within an axially extending band including the vertical positions of the shock wave attained in response to changes in nozzle flow area and/or manifold vacuum levels during part throttle operating conditions, the induction passage having a rectangular cross-section including a pair of mirror image arcuately formed movable walls facing one another and each having a convergent-divergent profile in cross-section.

3. An apparatus as in claim 2, the walls being interconnected and each pivotally mounted adjacent its upper end for concurrent swinging arcuate movements in opposite directions to contract or enlarge the throat and nozzle flow areas.

4. An apparatus as in claim 2, the means introducing fuel into the nozzle comprising a hollow tube connected to a source of fuel and projecting into the nozzle below the throat at a central location with respect to the movable walls.

5. An apparatus as in claim 4, the fuel tube having a fixed location so as to vary in proximity to the shock wave upon changes in nozzle flow area and/or manifold vacuum.

* * * * *